United States Patent [19]

Tsuda

[11] 4,436,333

[45] Mar. 13, 1984

[54] HAND OPERATED HOIST HAVING IMPROVED MEANS CONTROLLING FREE ROTATION OF A LOAD SHEAVE

[75] Inventor: Kinji Tsuda, Osaka, Japan

[73] Assignee: Elephant Chain Block Company Limited, Osaka, Japan

[21] Appl. No.: 250,157

[22] Filed: Apr. 2, 1981

[30] Foreign Application Priority Data

Apr. 1, 1980 [JP] Japan ..... 55-43130

[51] Int. Cl.[3] ..... B66D 1/04

[52] U.S. Cl. ..... 294/82 R; 254/358

[58] Field of Search ..... 294/82 R; 254/338, 358, 254/46; 24/116 R; 403/157, 73

[56] References Cited

U.S. PATENT DOCUMENTS 3,369,795 2/1968 Fujita ..... 254/358

3,894,720 7/1975 Koji ..... 254/358

FOREIGN PATENT DOCUMENTS 48-10759 2/1973 Japan .

54-38279 7/1979 Japan .

*Primary Examiner*—James B. Marbert

*Attorney, Agent, or Firm*—Stevens, Davis, Miller & Mosher

[57] ABSTRACT

A hand-operated hoist which hoists or hauls a load by operation of a hand-operated driving member to drive a drive shaft such that a sheave shaft having a load sheave is driven to move a load chain engageable therewith. The drive shaft is axially movable and a clutch mechanism is provided which controls, through the axial movement of the drive shaft, the freely rotatable condition of the sheave shaft such that, when the load sheave bears no load, the hand-operated driving member is reversely rotated to allow the sheave shaft to be freely rotatable.

5 Claims, 3 Drawing Figures

HAND OPERATED HOIST HAVING IMPROVED MEANS CONTROLLING FREE ROTATION OF A LOAD SHEAVE

FIELD OF THE INVENTION

This invention relates to a hand-operated hoist, and more particularly to a hand-operated hoist which has a hand-operated driving member for rotating a drive shaft screwable therewith and a load sheave driven by the drive shaft through a reduction gear mechanism for hoisting or hauling a load by means of a load chain engaging with the load sheave.

Included in the scope of the invention are hand wheel type hoists (hand-operated chain blocks) in which the driving member comprises an endless hand-operated chain and a hand wheel engageable therewith, and lever type hoists in which the driving member comprises a hand-operated lever.

BACKGROUND OF THE INVENTION

Generally, a hand-operated chain block hoist carries on the hand wheel an endless hand chain and on the load sheave a load chain having at its one end a hook. The hand chain, when pulled in one direction, rotates the hand wheel normally to hoist a load by the hook at an end of the load chain, or, when pulled in the other direction, rotates the hand wheel reversely to lower the load.

Hand-operated hoists, especially of the hand-operated chain block type, are so constructed that a hoist body is hung high above the ground and the hand chain is handled by a worker standing on the ground so that even if the hoist body is provided with a control mechanism operable to permit free rotation of the load sheave, he cannot operate it.

Accordingly, the hand chain must be moved to rotate the hand wheel so that the load sheave is rotated to either lift the load chain or lower it to the location of a load. However, since a reduction gear mechanism is interposed between the hand wheel and the load sheave (which transmits to the load sheave the hand wheel rotation reduced in speed), operation of the hand chain must be continued for a prolonged period of time in order to lift or lower the hoist hook. For example, in a hand-operated chain block of a one ton rating, a one meter vertical movement of the hook requires about 144 rotations of the hand wheel, requiring an extensive amount of time to lift or lower the hoist hook and bring it to a desired location, resulting in poor worker efficiency. Also, workers easily tire from the prolonged handling of the hand chain. Another problem which occurs is that workers operate the hand chain in a hurry when the hoist is not loaded which can result in disengagement of the chain from the hand wheel or jamming of the two which disables the hoist.

SUMMARY OF THE INVENTION

This invention has been designed to overcome the above-described problems by providing a driving member, such as a hand wheel, which can place a load sheave in a freely rotatable condition by the handling of a hand chain associated therewith. This invention provides a hand-operated hoist which is operable by a worker on the ground so that the load sheave carried on the hoist body can be placed in a freely rotatable condition by use of rotation of the hand-operated driving member even when the hoist body is hung high above and the driving member is hand-operated by the worker on the ground. Free rotation of the load sheave permits free and easy movement of the load chain. Accordingly, an object of the invention is to provide a hand-operated hoist capable of lifting or lowering a hook attached to the load chain easily, quickly and safely, so that workers are less tired from hoisting or lowering loads many times.

The hand-operated hoist of the invention is provided with a hoist body, means for hanging the body, a sheave shaft carrying the load sheave supported rotatably to the body, power operation means for driving the sheave shaft, and control means for placing the sheave shaft in a freely rotatable condition.

The power operation means includes a drive shaft, a hand-operated driving member screwably coupled with the drive shaft, a mechanical brake for locking the sheave shaft against reverse rotation and transmitting a driving force from the driving member to the drive shaft, and a reduction gear mechanism which reduces the speed of the driving force and transmits it to the sheave shaft. The drive shaft is supported to the sheave shaft so as to be axially movable with respect thereto and has an urging member for urging the driving member toward the mechanical brake, so that when the driving member is unscrewed, if the load sheave bears no load, the urging member acts to axially move the drive shaft.

The reduction gear mechanism includes first through fourth gears. At least one gear is adapted to axially move following axial movement of the drive shaft.

The control means includes a clutch mechanism which interrupts the driving force transmitted to the sheave shaft upon axial movement of the one gear which follows axial movement of the drive shaft. The interruption of driving force by the clutch mechanism allows the sheave shaft to freely rotate.

Among the first through fourth gears constituting the reduction gear mechanism, the fourth gear, which meshes with a third gear and transmits the driving force therefrom to the sheave shaft, is preferably used as the axially movable gear which follows the axial movement of the drive shaft.

A spring means interposed between the fourth gear and the hoist body is used mainly for allowing the fourth gear to follow the axial movement of drive shaft and may also be used as the urging member at the drive shaft.

These and other objects, features and advantages of the invention will become more apparent as the description proceeds which is provided in conjunction with the accompanying drawings.

DETAILED DESCRIPTION OF THE INVENTION

Figure 1:
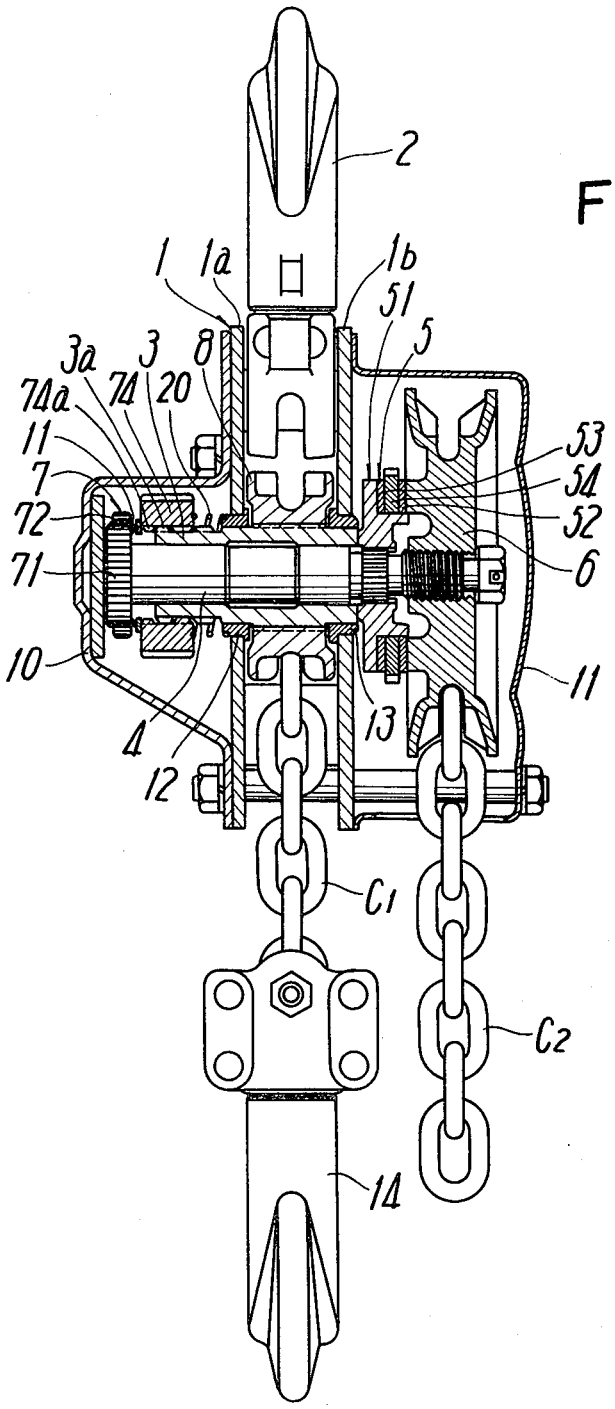
FIG. 1 is a longitudinally sectional front view of an embodiment of a hoist of the invention.

In the drawings, reference numeral 1 designates a hoist body comprising a pair of opposing base plates 1a and 1b spaced by a fixed interval. A cover 10 for covering a reduction gear mechanism 7 is fixed to the base plate 1a, and a cover 11 for covering a driving member 6 and a mechanical brake 5, is fixed to the base plate 1b, through respective fixing means such as bolts and nuts. The base plates 1a and 1b are fixed on the upper portions thereof to an upper hook 2 through a pin connection, and support at central portions thereof a tubular sheave shaft 3 journaled through a pair of bearings 12 and 13.

On the outer periphery of sheave shaft 3 is mounted a load sheave 8 in spline connection therewith, the load sheave 8 being positioned between the base plates 1a and 1b. The sheave shaft 3 projects at its one axial end outwardly from the base plate 1a and the projecting portion has ridge 3a at the outer periphery formed circumferentially of the projection and extending axially thereof.

A drive shaft 4 is inserted through the sheave shaft 3 in a manner permitting it to be rotatably and axially movable, and carries at one axial side (at the right-hand side in the drawing) a mechanical brake 5 and a driving member 6, and at the other side (at the left-hand side) a reduction gear mechanism 7 comprising first through fourth gears 71, 72, 73 and 74. The driving member 6, as shown in FIG. 1, comprises a hand wheel in engagement with an endless hand chain $C_2$.

The drive shaft 4 is larger in axial length than the sheave shaft 3 and projects at both axial ends outwardly from both axial ends of sheave shaft 3. A hub shell 51 constituting the mechanical brake 5 is spline-fitted onto the projection of one axial end of drive shaft 4 in a manner permitting it to be movable relative to the drive shaft 4, and the driving member 6 is screwably supported to drive shaft 4 axially outward from the hub shell 51. The first gear 71 of the reduction gear mechanism 7 is fixed onto the projection at the other axial end of drive shaft 4.

The mechanical brake 5 includes the hub sheel 51 in spline-connection with the drive shaft 4, a pair of lining plates 52 and 53, a ratchet wheel 54 interposed between the lining plates 52 and 53, a pawl 55 in mesh with the ratchet wheel 54, and the driving member 6. The mechanical brake 5, under normal rotation of the driving member 6, transmits the driving force therefrom to the drive shaft 4, and locks the drive shaft 4 against reverse rotation when it tends to reversely rotate due to a load applied to the load sheave 8.

In greater detail, the hub shell 51 is provided at its axial end with a flange 51a and rotatably supports at its outer periphery the lining plates 52 and 53 and ratchet wheel 54. The pawl 55 is supported swingably to the base plate 1b and meshes at its tip with the ratchet wheel 54, thereby controlling the ratchet wheel 54 to rotate only in the same direction as normal rotation of driving member 6.

The driving member 6 normally screws leftwards in the drawings with respect to the drive shaft 4 and contacts at the left-hand surface with the lining plate 52, while the hub shell 51 contacts at its left-hand surface with the right-hand end face of sheave shaft 3.

With this construction, the driving member 6, when normally rotated, further screws leftwards to bias the lining plates 52 and 53 and ratchet wheel 54 toward the flange 51a so that they are integral with the hub wheel 51. Hence, driving force is transmitted from the driving member 6 to the drive shaft 4 through the lining plate 52, ratchet wheel 54, lining plate 53, and hub shell 51, and then transmitted to the sheave shaft 3 by way of reduction gear mechanism 7, thereby driving the load sheave 8 to wind up a load chain $C_1$ engaging therewith, thus hoisting or hauling a load attached to a lower hook 14 at the load chain $C_1$.

Upon cessation of driving rotation of the driving member 6, while a load is suspended, the load sheave 8 which is subjected to the weight of the load will tend to rotate reversely, at which time the pawl 55 locks the ratchet wheel 54 and hub shell 51 integral therewith preventing them from reversely rotating, so that the drive shaft 4 is restrained from reversely rotating, thereby keeping the load safely suspended.

If under this condition, the driving member 6 is reversely rotated, it screws rightwards with respect to the drive shaft 4 and moves away from the lining plate 52, so that the hub shell 51 becomes rotatable. As a result, the reverse rotation transmitted from the load sheave 8 allows the drive shaft 4 to reversely rotate, thus lowering the suspended load. At this time, upon cessation of the reverse rotation of driving member 6, the reverse rotation of drive shaft 4 allows the driving member 6 to rotate relative to the drive shaft 4, so that the driving member 6 moves leftward to bias the lining plate 52 and becomes integral therethrough with the ratchet wheel 54, whereby the reverse rotation of drive shaft 4 is locked by the pawl 55.

The reduction gear mechanism 7 comprises the first gear 71 fixed to the drive shaft 4, two second gears 72 and two third gears 73 fixed to two intermediate shafts 75 respectively, and a fourth gear 74 supported to the sheave shaft 3, the intermediate shafts 75 being journaled between the base plate 1a and a gear cover 10 fixed thereto. The second gears 72 mesh with the first gear 71 and the third gears 73 mesh with the fourth gear 74.

Figure 3:
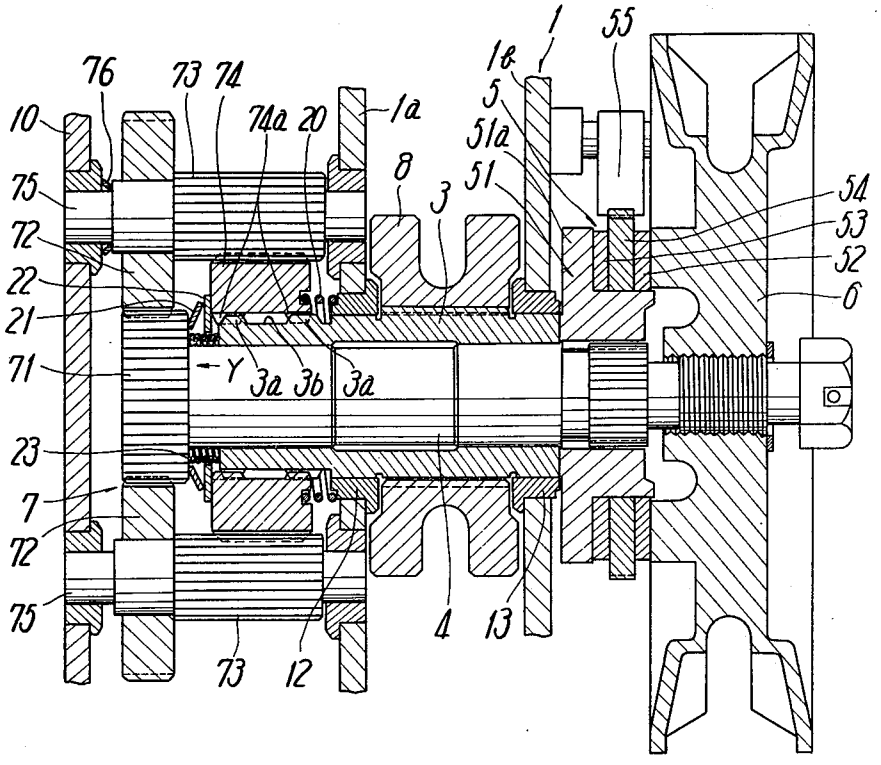
FIG. 3 is an enlarged longitudinal sectional view of the principal portion corresponding to FIG. 2, which shows the load sheave in a condition of normal operation.
Figure 2:
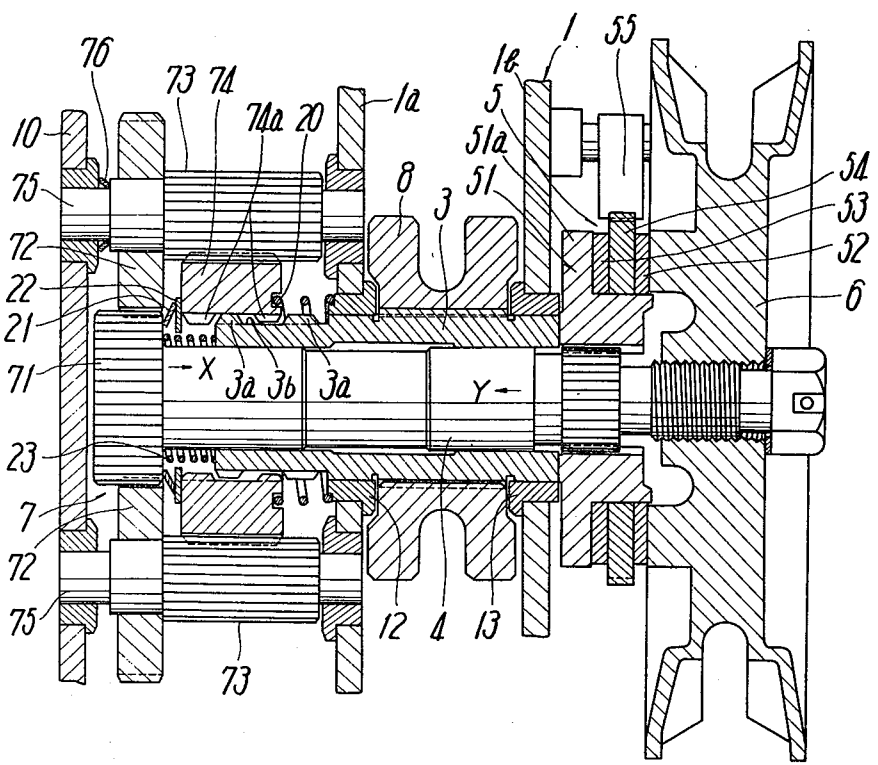
FIG. 2 is an enlarged longitudinal sectional view of the principal portion of the FIG. 1 embodiment, which shows a load sheave in a condition of being freely rotatable.

The drive shaft 4 is supported axially movably with respect to the sheave shaft 3, and an urging member 20 is provided which biases the drive shaft 4 in the direction of allowing the driving member 6 to press-contact with the lining plate 52 at mechanical brake 5, so that when the driving member 6 is unscrewed, i.e., reversely rotated, if the load sheave 8 bears no load, the urging member 20 acts to move the drive shaft 4 axially leftwards (in the direction of the arrow Y in FIGS. 2 and 3). One gear, e.g., the fourth gear 74 as shown, at the reduction gear mechanism 7, is made axially movable with respect to the sheave shaft 3 to thereby follow the axial movement of drive shaft 4. Furthermore, a control means comprising a clutch mechanism is provided which functions to interrupt transmission of the driving force to the load sheave 3, through the axial movement of gear 74 which follows axial movement of drive shaft 4.

The clutch mechanism comprises ridges 3a provided at the outer periphery of sheave shaft 3 and ridges 74a provided at the inner periphery of fourth gear 74, the ridges 74a being engageable with the ridges 3a. The fourth gear 74 axially moves in the direction of the arrow Y in the drawing with respect to the sheave shaft 3 to thereby disengage the ridges 74a from those 3a, thereby enabling the load sheave 8 to freely rotate.

This free rotation control of load sheave 8 is possible only when it bears no load. This can be seen as follows. The driving member 6, which reversely rotates when the load sheave 8 bears no load, screws rightwards in the drawing with respect to the drive shaft 4, at which time the unloaded load sheave 8 appies no reverse rotation to the drive shaft 4 so that mechanical brake 5 does not operate and the driving member 6 screws backward until it reaches the rearmost end of drive shaft 4.

The drive shaft 4, following the backward screwing movement of driving member 6, moves leftwards by action of the urging member 20. Referring to FIGS. 2 and 3, the urging member 20 is formed as a coiled spring interposed between the base plate 1*a* and the fourth gear 74. Between the fourth gear 74 and first gear 71, which is fixed to drive shaft 4, are interposed a control member 21 formed of a corrugated dish-like shaped spring and a washer 22, so that the urging member 20 functions to bias the drive shaft 4 to axially move leftwards in the drawing through the fourth gear 74, control member 21, and washer 22, and also allows the fourth gear 74 to follow the leftward movement of drive shaft 4. As a result, the fourth gear 74 moves axially leftwards following the axially leftward movement of drive shaft 4 so that the ridges 74*a* at the clutch mechanism disengage from the ridges 3*a* thereat allowing the load sheave 8 to freely rotate.

In the above-described construction, a second urging member 23, in addition to the urging member 20, may be provided between the first gear 71 and the sheave shaft 3, the second urging member 23 biasing the drive shaft 4 in the direction of the arrow Y in the drawing. In this instance, the urging member 20 may have a smaller urging force, that is just enough to allow the fourth gear 74 to follow the axial movement of drive shaft 4 in the direction Y.

The second gears 72 and third gears 73 are each subjected to a slight resistance against rotation. The reason for this is that friction is applied to the intermediate shafts 75 to prevent the drive shaft 4 from rotating together with a reverse rotation of driving member 6 when unloaded. A corrugated washer 76 is provided at each intermediate shaft 75 for this purpose. As an alternative, the rotational resistance applied to the second gears 72 and third gears 73 may be applied by dish-like shaped springs interposed between the second gears 72 and the gear cover 10.

The control member 21 has a spring force larger than that of the urging member 20 and is deflectable only when the fourth gear 74 is subjected to a resistance over a prescribed value against its axial movement in the direction of the arrow X in FIG. 2. In other words, the control member 21 transmits to the fourth gear 74 the movement of drive shaft 4 when moving axially rightwards (in the direction of the arrow X), thereby moving the fourth gear 74 rightwards. When the ridges 74*a* at the fourth gear 74 engage straight with the ridges 3*a* at the sheave shaft 3, the control member 21 does not deflect in transmitting the movement of drive shaft 4, however, it does deflect due to the rightward movement of drive shaft 4 when the ridges 74*a* interfere with the ridges 3*a* and do not engage therewith.

Upon deflection of control member 21, the fourth gear 74 is biased axially rightwardly (in the direction of the arrow X) by energy conserved in the deflected control member 21. In this condition, the mechanical brake 5 is actuated by the forward screwing driving member 6 to thereby rotate the drive shaft 4. As a result, the fourth gear 74 rotates to allow the ridges 74*a* to mate with grooves between the ridges 3*a* respectively, and then the fourth gear 74, biased by the urging member 21, moves rightwards to engage the ridges 74*a* with the ridges 3*a*.

It is preferable to have ridges 3*a* and 74*a* each cut out at its lengthwise intermediate portion so that the fourth gear 74 axially moves to allow the divided ridge portions to mutually meet with cutouts, thus disengaging the ridges 74*a* and 3*a* from each other. This reduces the control stroke of the fourth gear 74.

The hand-operated hoist of the invention operates as follows. The hoist body 1 is hung high through the upper hook 2 and a load is attached to the lower hook 14. The hand chain $C_2$ is then pulled in one direction to normally rotate the driving member 6 causing the sheave shaft 3 to be driven through the mechanical brake 5 and reduction gear mechanism 7 and the load sheave 8 to be normally rotated, thereby hoisting the load. If the hand chain $C_2$ is pulled in the other direction to reversely rotate the driving member 6, the load will be lowered.

FIG. 2 shows the load sheave 8 placed in a condition where it is freely rotatable, and FIG. 3 shows the same placed in a condition of being driven. The load sheave 8 is changed over from the FIG. 2 condition to the FIG. 3 condition when it is desired to hoist or lower a load.

The change from the free rotation condition of load sheave 8 to the driven condition will now be described.

The driving member 6, which normally rotates, tends to axially move leftwards (in the direction of the arrow Y in FIG. 2), but is subjected to a greater resistance against its axially leftward movement after contacting with the lining plate 52, whereby the drive shaft 4, which is axially movable, moves rightwards (in the direction of the arrow X in FIG. 2) against the urging member 20 upon continued rotational screwing of driving member 6. The fourth gear 74, following the movement of drive shaft 4 through the control member 21, moves in the direction of the arrow X in FIG. 2, so that the ridges 74*a* at the fourth gear 74 engage with the ridges 3*a* at the sheave shaft 3. If the ridges 74*a* interfere with the ridges 3*a*, the fourth gear 74 rotates through the rotation of drive shaft 4 and is biased by the deflected urging member 21 to move rightwards thus engaging the clutch mechanism.

Upon engagement of fourth gear 74 with sheave shaft 3 as shown in FIG. 3, the drive shaft 4 stops its axial movement, so that the driving member 6, when further normally rotated, screws leftwards with respect to the drive shaft 4. The thrust of the screwing driving member 6 integrates the driving member 6 with the lining plate 52, ratchet wheel 54, lining plate 53, and flange 51*a* of hub shell 51, whereby a driving force is transmitted from the driving member 6 to the load sheave 8 by way of drive shaft 4, reduction gear mechanism 7 and sheave shaft 3, thus driving the load sheave 8.

The change over of the load sheave 8 from its driven condition shown in FIG. 3 again to the freely rotatable condition in FIG. 2 will now be described. In its freely rotatable condition, the load sheave 8 allows the movement of the load chain $C_1$ to permit the lower hook 14 to be brought to a location of a load to be hoisted. When the load sheave 8 bears no load the load sheave 8 is placed in its freely rotatable condition by simple operation of hand chain $C_2$.

In detail, the driving member 6 reversely rotates to screw rightwards in FIG. 3 and away from the lining plate 52, whereby the drive shaft 4 is biased by the urging member 20 to move leftwards (in the direction Y) and the fourth gear 74 also is biased by the urging member 20 to move axially leftwards following the movement of drive shaft 4. As a result, the ridges 74*a* at the fourth gear 74 disengage from the ridges 3*a* at the sheave shaft 3 to allow free rotation of the load sheave 8.

Thus, the changeover of load sheave 8 into a freely rotatable condition can be accomplished with ease by a worker on the ground even when the hoist body 1 is hung high and not accessible. Also, the freely rotatable condition of load sheave 8 enables lifting or lowering of lower hook 14 without operation of driving member 6, but with only a pull of load chain $C_1$. Thus, the lower hook 14 is quickly brought to location of a load to be hoisted or hauled.

The lower hook 14 can be grasped and lowered by the worker or a cord may be attached to the hook and used to lower it when it is positioned too high. The lower hook 14 is lifted by pulling the load chain $C_1$ on the reverse side to the hook mounting side.

Free rotation of load sheave 8 will not occur if it bears a load, even if the driving member 6 is reversely rotated, because the fourth gear 74 is affected by the load on load sheave 8 and will remain stationary. On the other hand, the driving member 6, when in normal rotation, uses its thrust to restrain the fourth gear 74 from axially moving, so that the load sheave 8, once the ridges 74*a* engage with the ridges 3*a*, can never be placed in a freely rotatable condition.

Another alternative arrangement which may be used to overcome the interference of ridges 74*a* with those of 3*a* comprises a slant guide face formed at one lengthwise end of each rdige 74*a* to mate with each groove between ridges 3*a*. The means for preventing the rotation of drive shaft 4 together with the driving member 6 when unloaded alternatively may comprise a spring having a smaller spring force than that of urging member 20, the spring being supported at its one end to the drive shaft 4 and brought at the other end into contact with an end face of drive shaft 4 at the first gear 71 side, or the inner surface of gear cover 10, thereby applying a resistance only against the rotation of drive shaft 4, but not against the axial movement thereof in the direction of the arrow X in FIG. 2.

The means for making the load sheave 8 freely rotatable, alternatively may use axial movement of one of the first gear 71, second gears 72 or third gears 73 instead of the fourth gear 74.

Furthermore, this invention may be applied to a hand-operated hoist having the driving member 6 operated by means of a hand-operated lever.

As clearly understood from the above description, the hand-operated hoist of the invention is adapted to reversely rotate the driving member for driving the load sheave, so that a worker can handle the hand chain even on the ground at a position remote from the hoist body to thereby place the load sheave in a freely rotatable condition. The freely rotatable condition of the load sheave permits quick lifting or lowering of the lower hook at the load chain. The load sheave, which is placed in its freely rotatable condition solely by reverse rotation of the driving member when the load sheave is unloaded, eliminates the need to continuously operate the hand chain for a prolonged time period to place the load hook in a desired position. Thus the hook is movable with ease and in safety, and there is no fear of the hand chain disengaging from the hand wheel or jamming therewith. As a result, the hoist of the invention considerably improves worker efficiency in comparison with convention hoists and reduces worker fatigue.

Furthermore, the load sheave, when a load is applied thereto, is prevented from being carelessly put in the freely rotatable condition, because the thrust caused by rotation of the driving member is utilized to forcibly move the drive shaft axially with respect to the sheave shaft to thereby put the load sheave in a driven condition. Moreover, since the gear at the reduction gear mechanism must be axially moved to make the load sheave freely rotatable, it is impossible for the load sheave, even when the driving member is reversely rotated, to become freely rotatable as long as the load sheave bears a load to be hoisted or lowered. Since the load sheave, when loaded, can never be put in freely rotatable condition, safety in handling of the hoist is assured.

Since the hoist of the invention utilizes operation of the driving member to place the load sheave in a freely rotatable condition, there is no need for a separate control member, and the hoist construction remains uncomplicated and inexpensive to produce.

While a preferred embodiment of the invention has been shown and described, the invention is not limited to the specified construction thereof as many modifications can be made thereto without departing from the spirit and scope of the invention. Accordingly, the invention is not limited by the above description but only as defined in the attached claims.

What is claimed is:

1. A hand-operated hoist comprising a hoist body, means for hanging said body, a sheave shaft having a load sheave supported rotatably to said body, power operation means for driving said sheave shaft, and control means for permitting rotation of said sheave shaft, said power operation means comprising a drive shaft, a rotatably driven hand wheel driven by an endless chain, said hand wheel being coupled with said drive shaft by screw means, a mechanical brake for locking reverse rotation of said sheave shaft and for transmitting a driving force from said hand wheel when it rotates in a driving direction to said drive shaft, and a reduction gear mechanism comprising a plurality of gears through which the driving force from said hand wheel is reduced in speed and transmitted to said sheave shaft, said drive shaft being supported to said sheave shaft so as to be axially movably with respect thereto and having an urging member for urging said hand wheel toward said mechanical brake, so that when said hand wheel is unscrewed by being rotated reversely to said driving direction, when said load sheave bears no load, said drive shaft axially moves in a first direction under the action of said urging member and at least one of the gears of said reduction gear mechanism axially moves in said first direction to follow axial movement of said drive shaft, said control means including a clutch mechanism which functions upon axial movement of said gear following axial movement of said drive shaft to disengage and interrupt the driving force transmitted to said sheave shaft thereby allowing said sheave shaft to freely rotate, said at least one gear being provided with a spring means for biasing said clutch mechanism in a disengaging position so that when said hand wheel is rotated reversely the axial movement of said gear following said drive shaft in said first direction causes said spring means to operate to disengage said clutch mechanism permitting free rotation of said load sheave, and means for axially forcibly moving said driving shaft and said gear in a second direction opposite the first upon relative rotation of said hand wheel with respect to said driving shaft when said hand wheel is changed in rotational direction from a reverse rotation direction to said driving direction.

2. A hand-operated hoist according to claim 1, wherein the said reduction gear mechanism comprises a first gear fixed to said drive shaft, a pair of second gears each engageable with said first gear, a pair of third gears respectively fixed to intermediate shafts which are suported rotatably to said hoist body and a fourth gear supported so as to be axially movable relative to said sheave shaft and engageable with said third gears, said clutch mechanism being provided between said fourth gear and said sheave shaft, said spring means being positioned between said fourth gear and hoist body and causing said fourth gear to follow axial movement of said drive shaft.

3. A hand-operated hoist according to claim 2, wherein said clutch mechanism comprises a number of ridges disposed circumferentially on both said sheave shaft and fourth gear, said ridges being respectively cut out at axially fixed intervals.

4. A hand-operated hoist according to claim 2, wherein an elastic member having a larger elastic force than said spring means is interposed between said first and fourth gears.

5. A hand-operated hoist according to claim 1, wherein said driving member comprises a hand wheel and an endless hand-operated chain engageable therewith.

* * * * *